US007059366B2

(12) United States Patent
Dolson

(10) Patent No.: US 7,059,366 B2
(45) Date of Patent: Jun. 13, 2006

(54) AIR BLEED MECHANISM FOR A SUBMERSIBLE TURBINE PUMP

(75) Inventor: Richard Dolson, Collinsville, CT (US)

(73) Assignee: Veeder-Root Company, Simsbury, CT (US)

( * ) Notice: Subject to any disclaimer, the term of this patent is extended or adjusted under 35 U.S.C. 154(b) by 265 days.

(21) Appl. No.: 10/809,320

(22) Filed: Mar. 24, 2004

(65) Prior Publication Data

US 2005/0211329 A1 Sep. 29, 2005

(51) Int. Cl.
*B65B 1/04* (2006.01)

(52) U.S. Cl. ..... 141/59; 141/301; 417/405

(58) Field of Classification Search ..... 141/59, 141/286, 301, 302; 417/405–407, 397
See application file for complete search history.

(56) References Cited

U.S. PATENT DOCUMENTS

| | | | | |
|---|---|---|---|---|
| 3,587,633 | A | 6/1971 | Young | 137/551 |
| 4,260,000 | A * | 4/1981 | McGahey et al. | 141/59 |
| 5,249,696 | A | 10/1993 | Bryant et al. | 220/367 |
| 5,577,895 | A | 11/1996 | Franklin et al. | 417/238 |
| 5,673,732 | A | 10/1997 | Kenney et al. | 141/59 |
| 5,715,798 | A | 2/1998 | Bacon et al. | 123/514 |
| 5,762,104 | A | 6/1998 | Green et al. | 137/513.7 |
| 5,769,134 | A | 6/1998 | Kenney et al. | 141/59 |
| 5,904,472 | A * | 5/1999 | Olson et al. | 417/405 |
| 5,924,853 | A | 7/1999 | Pacht | 417/567 |
| 5,927,954 | A | 7/1999 | Kennedy et al. | 417/397 |
| 5,934,508 | A | 8/1999 | Kenney et al. | 222/55 |
| 6,070,760 | A | 6/2000 | Kenney et al. | 222/55 |
| 6,126,409 | A | 10/2000 | Young | 417/297 |
| 6,158,460 | A | 12/2000 | Clark et al. | 137/561 A |
| 6,158,982 | A | 12/2000 | Kennedy et al. | 417/397 |
| 6,223,765 | B1 | 5/2001 | Small et al. | 137/312 |
| 6,241,492 | B1 | 6/2001 | Pacht | 417/567 |
| 6,357,723 | B1 | 3/2002 | Kennedy et al. | 251/322 |
| 2001/0035515 | A1 | 11/2001 | Kennedy et al. | 251/322 |
| 2003/0065425 | A1 | 4/2003 | Goodwin et al. | 700/282 |
| 2004/0039549 | A1 | 2/2004 | Watzke, Jr. et al. | 702/183 |

FOREIGN PATENT DOCUMENTS

| | | |
|---|---|---|
| DE | 10041555 A1 | 3/2002 |
| GB | 850290 | 10/1960 |

* cited by examiner

*Primary Examiner*—Steven O. Douglas
(74) *Attorney, Agent, or Firm*—Withrow & Terranova, PLLC

(57) ABSTRACT

A manifold for a submersible turbine pump having an air bleed mechanism for removing air from a discharge chamber of the manifold. The manifold includes the discharge chamber that receives fuel pumped from an underground storage tank (UST), the air bleed mechanism, an air return path coupled to the UST, and a bypass tube coupled to the air return path. When the air bleed mechanism is activated, the fuel discharge chamber is fluidly coupled to the bypass tube, thereby allowing air from the fuel discharge chamber to flow to the ullage of the UST. In one embodiment, the air bleed mechanism is an air bleed screw inserted into a threaded orifice in the manifold. The threaded orifice is coupled to both the bypass tube and the fuel discharge chamber. When the air bleed screw is rotated upward, the bypass tube is coupled to the fuel discharge chamber.

17 Claims, 5 Drawing Sheets

AIR BLEED MECHANISM FOR A SUBMERSIBLE TURBINE PUMP

FIELD OF THE INVENTION

The present invention relates to a manifold for a submersible turbine pump, and more particularly relates to a manifold including an air bleed mechanism for removing air from a discharge chamber of the manifold and returning the air to an underground storage tank.

BACKGROUND OF THE INVENTION

Submersible turbine pumps (STPs) are used at fuel dispensing sites to pump fuel from an underground storage tank (UST) to a plurality of fuel dispensers. The STP contains a turbine pump that draws fuel out of the UST. The STP includes a manifold that receives fuel from the UST through a riser pipe and that transfers the fuel to the fuel dispensers via a fuel piping network. When servicing of the STP is required, the STP is decoupled from the piping network and a top, or "packer," is removed from the manifold of the STP. After the STP has been serviced, the packer is placed back on the manifold and the STP is re-coupled to the fuel dispensers. Accordingly, air from the atmosphere is trapped inside the manifold and in the piping network leading to the fuel dispensers. One particular location where air is trapped is in a fuel discharge chamber of the manifold.

If the air is not removed from the manifold, the air will ultimately be trapped in the fuel piping network and dispensed during the sale of fuel. Further, the air trapped in the manifold negatively influences both mechanical and electrical leak detection systems, and therefore must be removed for these systems to operate properly. However, to remove the air trapped in the manifold and piping, a technician must activate the nozzles of each fuel dispenser downstream of the STP.

Thus, there remains a need for a manifold for a STP allowing air to be removed from the discharge chamber after servicing without the need for a technician to activate each fuel dispenser coupled to the STP.

SUMMARY OF THE INVENTION

The present invention provides a manifold for a submersible turbine pump (STP) having an air bleed mechanism for removing air from a discharge chamber of the manifold. The manifold includes a discharge chamber that receives fuel pumped from an underground storage tank (UST), an air bleed mechanism, an air return path coupled to the UST, and a bypass tube coupled to the air return path. When the air bleed mechanism is activated, the fuel discharge chamber is coupled to the bypass tube and a pressure differential between the fuel discharge chamber and the air return path forces air to flow from the fuel discharge chamber to the ullage of the UST.

The air bleed mechanism includes an air bleed screw inserted into a threaded orifice in the manifold. The threaded orifice is coupled to both the bypass tube and the fuel discharge chamber. When the air bleed screw is rotated downward, the bypass tube is fluidly decoupled from the fuel discharge chamber. When the air bleed screw is rotated upward, the bypass tube is fluidly coupled to the fuel discharge chamber. In this manner, a technician can control the removal of air via the air bleed screw.

The air bleed screw includes a head portion and a shaft portion. The head portion allows the air bleed screw to be manually rotated by a technician having a screw driver. The shaft portion includes a sealing portion and a threaded portion. The sealing portion prevents fuel and/or vapors from leaking into the environment. The sealing portion further seals the fuel discharge chamber from the bypass tube when the air bleed screw is rotated downward.

In one embodiment, the threaded portion of the air bleed screw includes at least one flat, vertical side that creates an air flow passage between threaded portion of the air bleed screw and the threaded orifice into which the screw is inserted. The air flow passage created by the at least one flat, vertical side allows air to easily flow from the fuel discharge chamber to the bypass tube when the air bleed screw is rotated upward.

The air bleed screw may also include a pin passing through an orifice in the shaft portion at a location that is within the fuel discharge chamber. The pin prevents the air bleed screw from being completely removed from the manifold, thereby preventing misplacement of the screw and leakage of fuel, air, and/or vapors into the environment.

Those skilled in the art will appreciate the scope of the present invention and realize additional aspects thereof after reading the following detailed description of the preferred embodiments in association with the accompanying drawing figures.

BRIEF DESCRIPTION OF THE DRAWINGS

The accompanying drawing figures incorporated in and forming a part of this specification illustrate several aspects of the invention, and together with the description serve to explain the principles of the invention.

DETAILED DESCRIPTION OF THE PREFERRED EMBODIMENTS

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Figure 1:
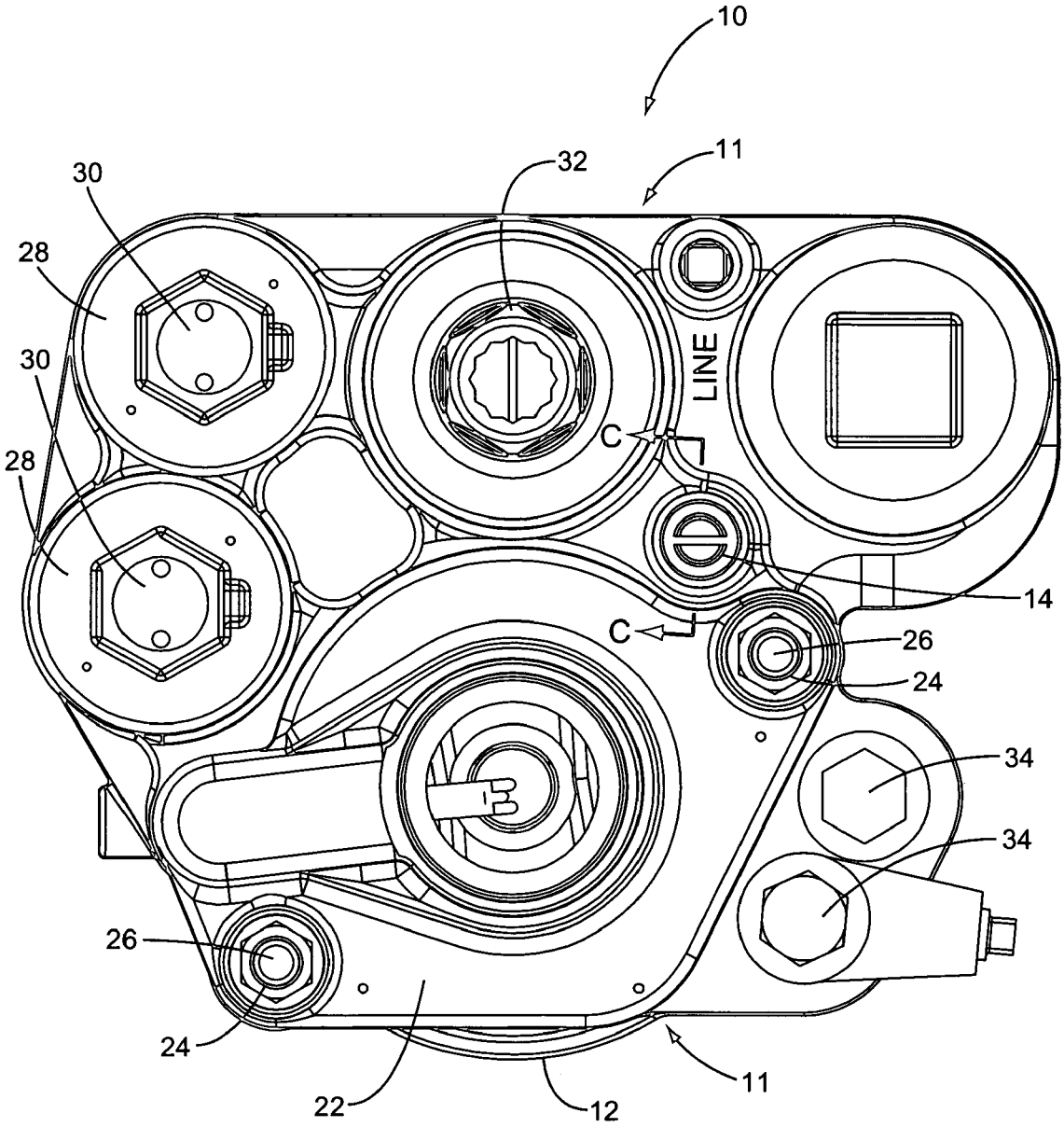
FIG. 1 is a schematic top-view diagram of the submersible turbine pump according to the present invention.
Figure 2:
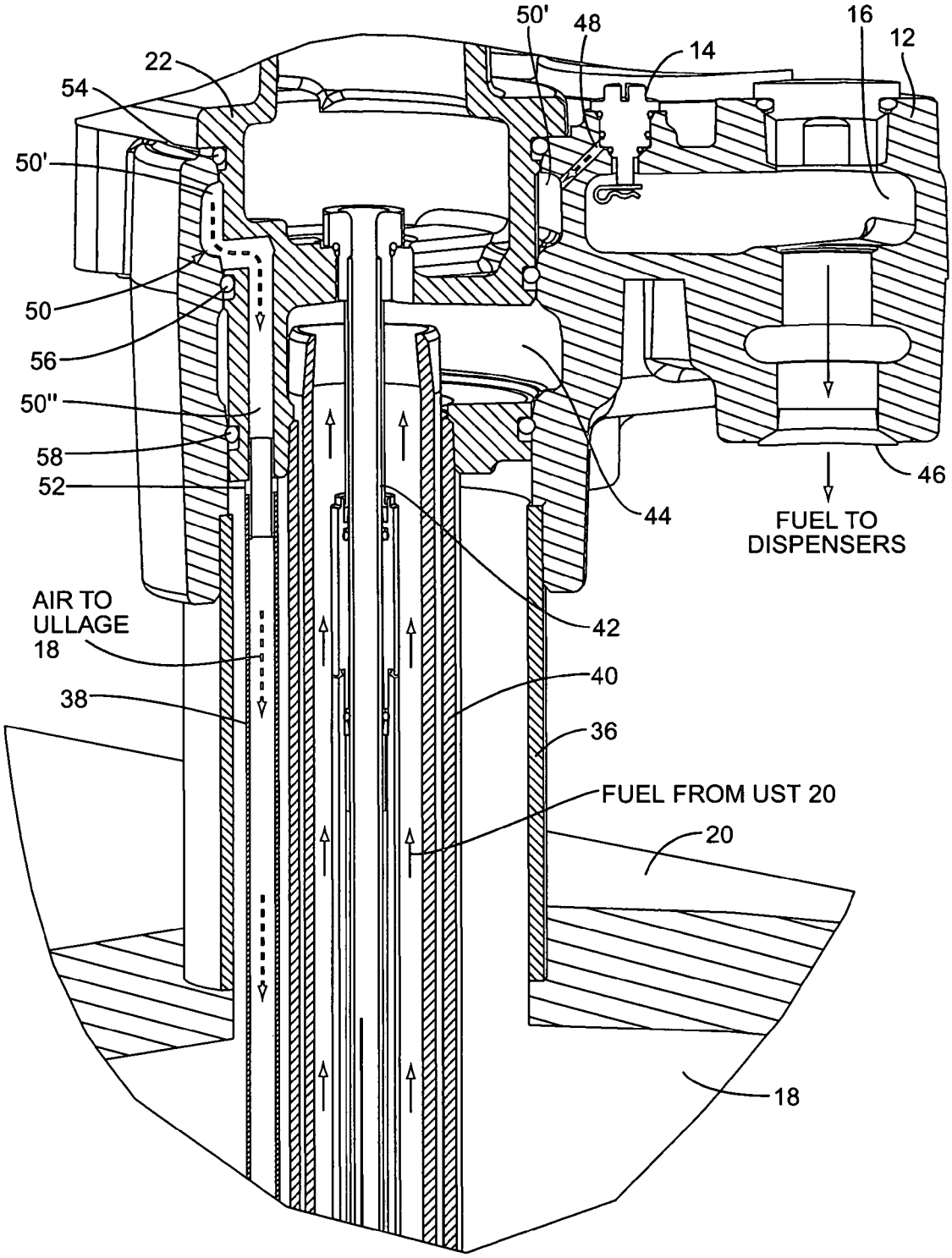
FIG. 2 is a cross-sectional diagram across the C—C line of the STP illustrated in FIG. 1 showing the air bleed mechanism and the internal air flow path for discharging the air to the underground storage tank according to the present invention.

As illustrated in FIG. 1, the submersible turbine pump (STP) 10 of the present invention provides a casing 11 and includes a manifold 12. According to the present invention the manifold 12 includes an air bleed mechanism 14 that when activated bleeds air from a fuel discharge chamber 16 (FIG. 2) into an ullage area 18 (FIG. 2) of an underground storage tank 20 (FIG. 2). When the air bleed mechanism is deactivated the fuel discharge chamber 16 is fluidly decoupled from the ullage area 18. The air bleed mechanism 14 is particularly beneficial in that it allows air trapped in the fuel discharge chamber 16 after servicing of the manifold 12 to be removed from the fuel discharge chamber 16 and transferred to the ullage 18 of the UST 20. As illustrated in the embodiment of FIG. 1, the air bleed mechanism 14 is an air bleed screw inserted into a threaded orifice.

The casing 11 of the STP 10 includes the manifold 12 and a top 22, also called a "packer," that is normally closed. The packer 22 fits on top of the manifold 12 to form a tight seal when the STP 10 is in its normal configuration. The packer 22 is secured to the casing 11 and the manifold 12 by a plurality of fasteners, also called "nuts" 24 that fit onto studs 26 and are tightened down to secure the packer 22 to the manifold 12. When the STP 10 needs to be serviced, the packer 22 can be removed from the manifold 12 by loosening the nuts 24, thereby allowing access to the internal components of the STP 10 including the fuel discharge chamber 16 (FIG. 2). The nuts 24 can be loosened by applying a socket or wrench to the nuts 24 and rotating the nuts 24 counterclockwise.

The casing 11 also includes plugs 28 having hexagon fasteners 30, a check valve extraction housing 32, and siphon connections 34. The details of the plugs 28, the check valve extraction housing 32, and the siphon connections 34 are included as part of the present invention and are contained in Provisional U.S. Patent Application Ser. No. 60/510,735, filed on Oct. 11, 2003 and owned by the same assignee as the present invention. Provisional U.S. Patent Application Ser. No. 60/510,735 is hereby incorporated by reference in its entirety. More information on a submersible turbine pump and its operations that is applicable to the STP 10 of the present invention is disclosed in U.S. Pat. No. 6,223,765, incorporated herein by reference in its entirety.

FIG. 2 illustrates a cross-sectional diagram of the casing 11 along line C—C shown in FIG. 1 to better show the internal workings of the air bleed mechanism 14 in accordance with the present invention. The manifold 12 is coupled to the UST 20 via a riser pipe 36. The riser pipe 36 encloses an air return conduit 38, which is discussed in detail below, and a boom 40. The boom 40 provides a fuel flow path and encloses an electrical conduit 42. The electrical conduit 42 encloses electrical wiring that provides power to a turbine pump (not shown) drawing fuel out of the UST 20. As indicated by the solid arrows, the fuel is pumped from the UST 20 through the boom 40 and into an inlet port 44 of the manifold 12. The fuel passes through various chambers within the manifold 12 and ultimately flows into the fuel discharge chamber 16. Once in the fuel discharge chamber 16, the fuel flows out of the manifold 12 to a piping network underneath a service station (not shown) and into fuel dispensers (not shown) through an outlet port 46.

According to the present invention, the manifold 12 also includes the air bleed screw 14 for removing air from the fuel discharge chamber 16 and returning the air to the ullage 18 of the UST 20. Air becomes trapped in the fuel discharge chamber 16 during servicing of the STP 10 as discussed in the background section. In general, the air bleed screw 14 is activated by rotating the air bleed screw counterclockwise, or loosening the air bleed screw 14. When the air bleed screw 14 is activated, or loosened, the air bleed screw 14 moves upward such that the fuel discharge chamber 16 is fluidly coupled to a bypass tube 48. The bypass tube 48 is coupled to an air return path including an air return chamber 50 and the air return conduit 38. Thus, when the air bleed screw 14 is loosened, a pressure differential between the fuel discharge chamber 16 and the air return chamber 50 forces air to flow from the fuel discharge chamber 16 through the bypass tube 48, the air return chamber 50, and air return conduit 38 to the ullage 18 of the UST 20, as indicated by dashed arrows. The pressure in the fuel discharge chamber 16 is greater than the pressure in the air return chamber 50, and the pressure in the air return chamber 50 is typically at atmosphere.

The air return chamber 50 includes a first portion 50' that is substantially cylindrical and circumscribes the packer 22. A second portion 50" of the air return chamber 50 is formed within the packer 22 and operates to fluidly couple the first portion 50' of the air return chamber 50 to the air return conduit 38. In one embodiment, the air return chamber 50 is fluidly coupled to the air return conduit 38 via a connector, such as a brass barbed connector 52. Further, in one embodiment, the air return conduit 38 is a polyethylene tube. The air return chamber 50 is sealed from the environment and the inlet port 44 of the manifold 12 by O-rings 54–58. A first O-ring 54 seals the air return chamber 50 from the environment, and second and third O-rings 56 and 58 seal the air return chamber 50 from the inlet port 44.

It should be noted that when the packer 22 is removed from the manifold 12, the inlet port 44 and the first portion 50' of the air return chamber 50 combine to form a packer receiving orifice in the manifold 12. When the packer 22 is placed into the packer receiving orifice, the packer 22 separates the packer receiving orifice into the inlet port 44 and the first portion 50', and the second portion 50" of the air return chamber 50 is formed through the packer 22.

Figure 3:
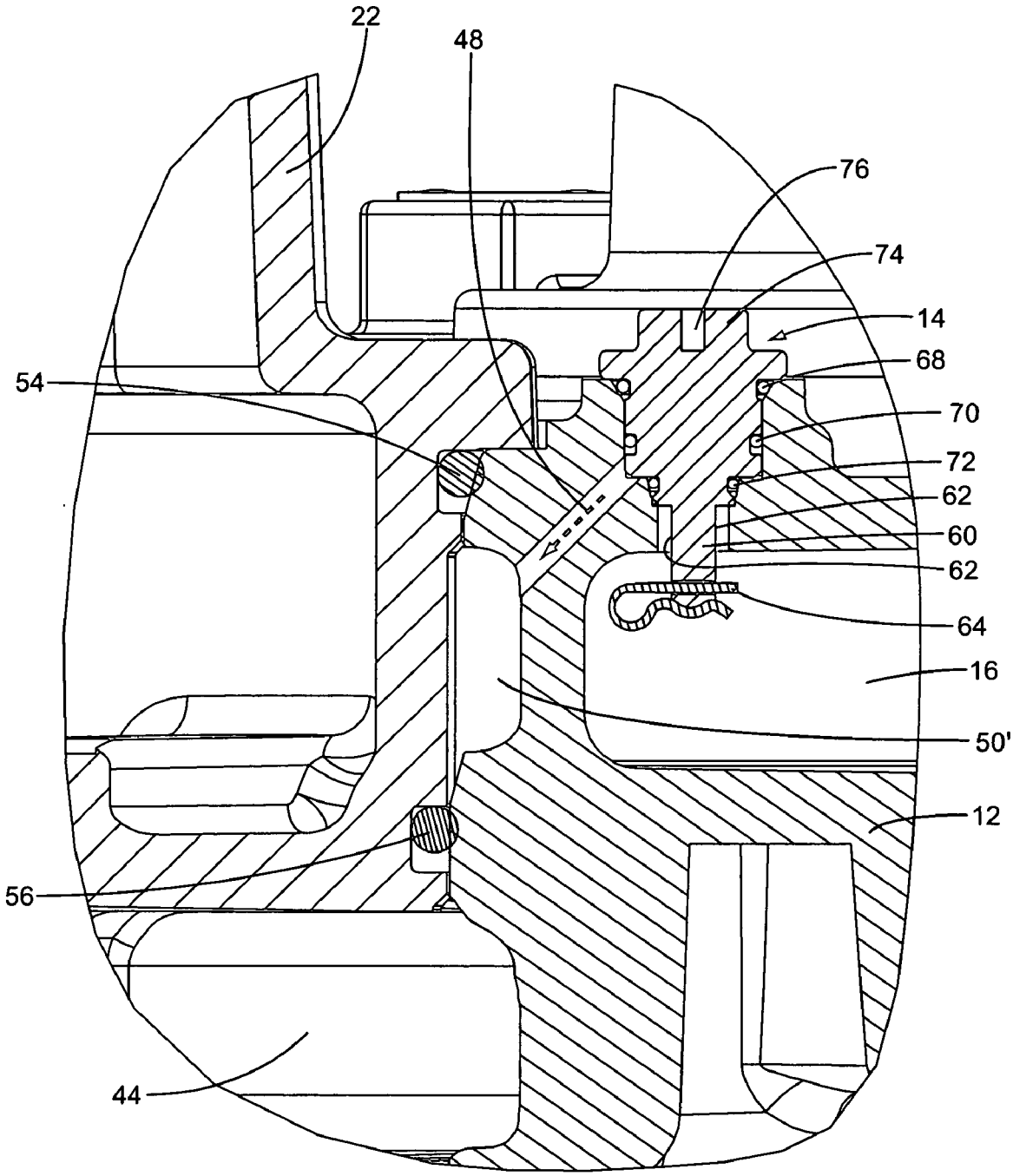
FIG. 3 is an enlarged a cross-sectional diagram of the air bleed mechanism illustrated in FIG. 2.
Figure 4A:
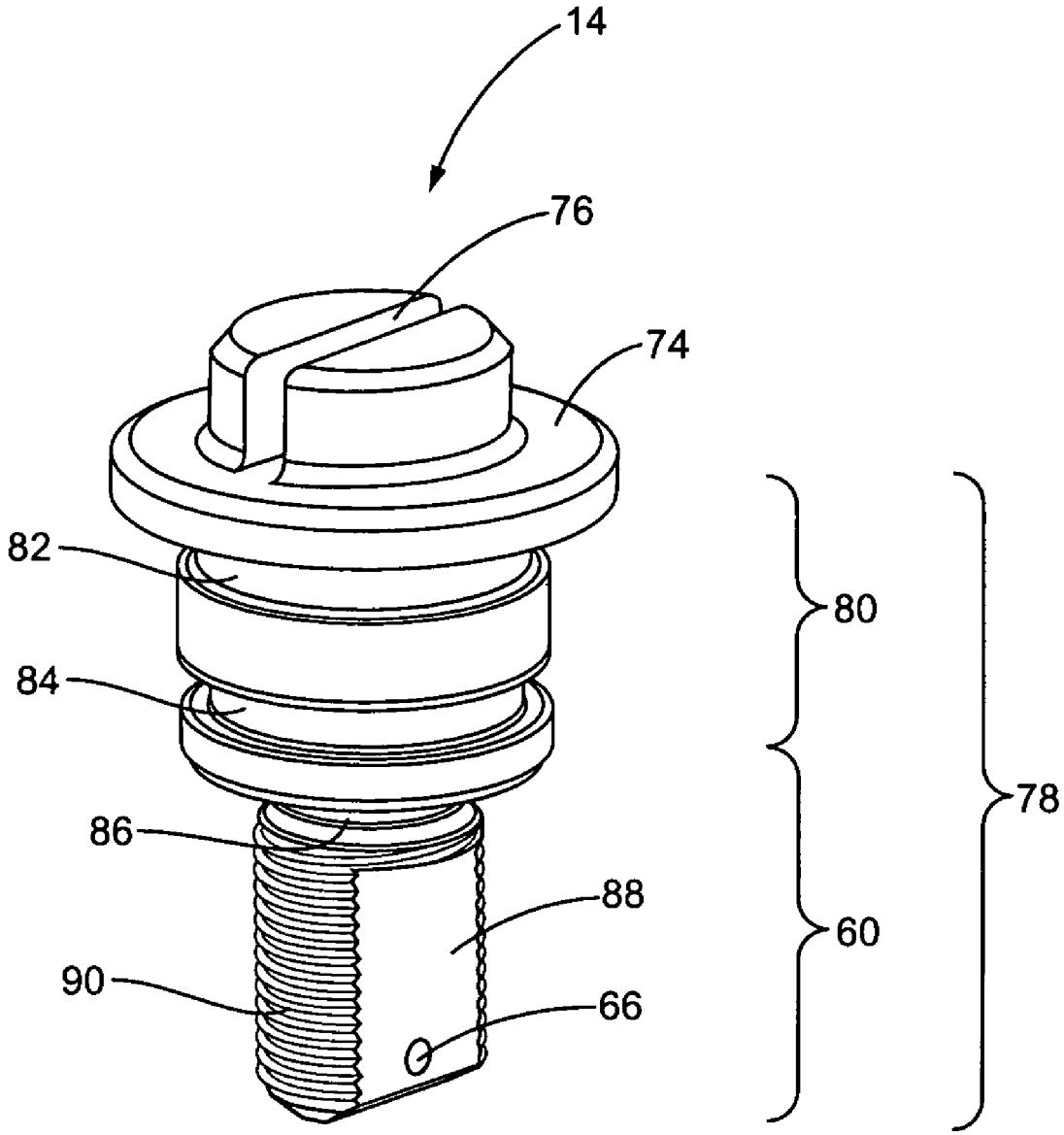
FIG. 4A is a diagram of the air bleed screw according to the present invention.

FIG. 3 is an exploded view of the air bleed screw 14 of FIG. 2. As discussed in more detail below, the air bleed screw 14 includes a threaded portion 60 having one or more flat, vertical sides 88 (FIG. 4A). The flat, vertical sides 88 form passages 62 through which air can flow from the fuel discharge chamber 16. Thus, when the air bleed screw 14 is rotated upward, the passages 62 also move upward until they are fluidly coupled with the bypass tube 48. The air bleed screw 14 also includes a pin 64 that passes through an orifice 66 (FIG. 4A) in the threaded portion 60 of the air bleed screw 14. The orifice 66 is through a point of the threaded portion 60 that is within the fuel discharge chamber 16. The pin 64 prevents the air bleed screw 14 from being completely removed from the manifold 12 so that the air bleed screw 14 is not misplaced by a service technician and/or so that the air, vapors, or fuel do not leak into the environment by removing the air bleed screw 14. Further, the pin 64 may be located at a point on the threaded portion 60 to serve as a limiter of the upward movement of the air bleed screw 14 to a point where maximum fluid coupling between the passages 62 and the bypass tube 48 occurs.

The air bleed screw 14 also includes O-rings 68, 70, and 72. The first O-ring 68 prevents water and debris from entering the orifice in which the air bleed screw 14 is inserted. The second O-ring 70 prevents fuel, air, and/or vapors from leaking into the environment when the air bleed screw 14 is adjusted. The third O-ring 72 prevents fuel, air, and/or vapors from flowing from the fuel discharge chamber 16 and into the bypass tube 48 when the air bleed screw 14 is tightened down. The air bleed screw 14 also includes a head portion 74 having a slot 76. The slot 76 receives a head of a screw driver such that a technician can manually rotate the air bleed screw 14 to either tighten the air bleed screw 14 or to loosen the air bleed screw 14.

FIG. 4A is a schematic diagram of the air bleed screw 14. The air bleed screw 14 includes a shaft portion 78 and the head portion 74. As discussed above, the head portion 74 includes the slot 76 for receiving the head of a screw driver. The shaft portion 78 includes a sealing portion 80 and the threaded portion 60. The sealing portion 80 includes recesses 82, 84, and 86 where the O-rings 68, 70, and 72 are to be attached. The threaded portion 60 includes the orifice 66 through which the pin 64 (FIG. 3) passes to prevent the air bleed screw 14 from being removed from the manifold 12. The threaded portion 60 also includes at least one flat, vertical side 88 and at least one threaded side 90. It should be noted that the threaded portion 60 is substantially cylindrical and includes the at least one flat, vertical side 88. The remaining sides are the threaded sides 90. As discussed above, the flat, vertical sides 88 form passages 62 (FIG. 3) through which air can easily flow. It should also be noted that in another embodiment, the threaded portion 60 may have no flat, vertical sides 88, and the air flow from the fuel discharge chamber 16 to the bypass tube 48 occurs between the threads of the threaded portion 60.

Figure 4B:
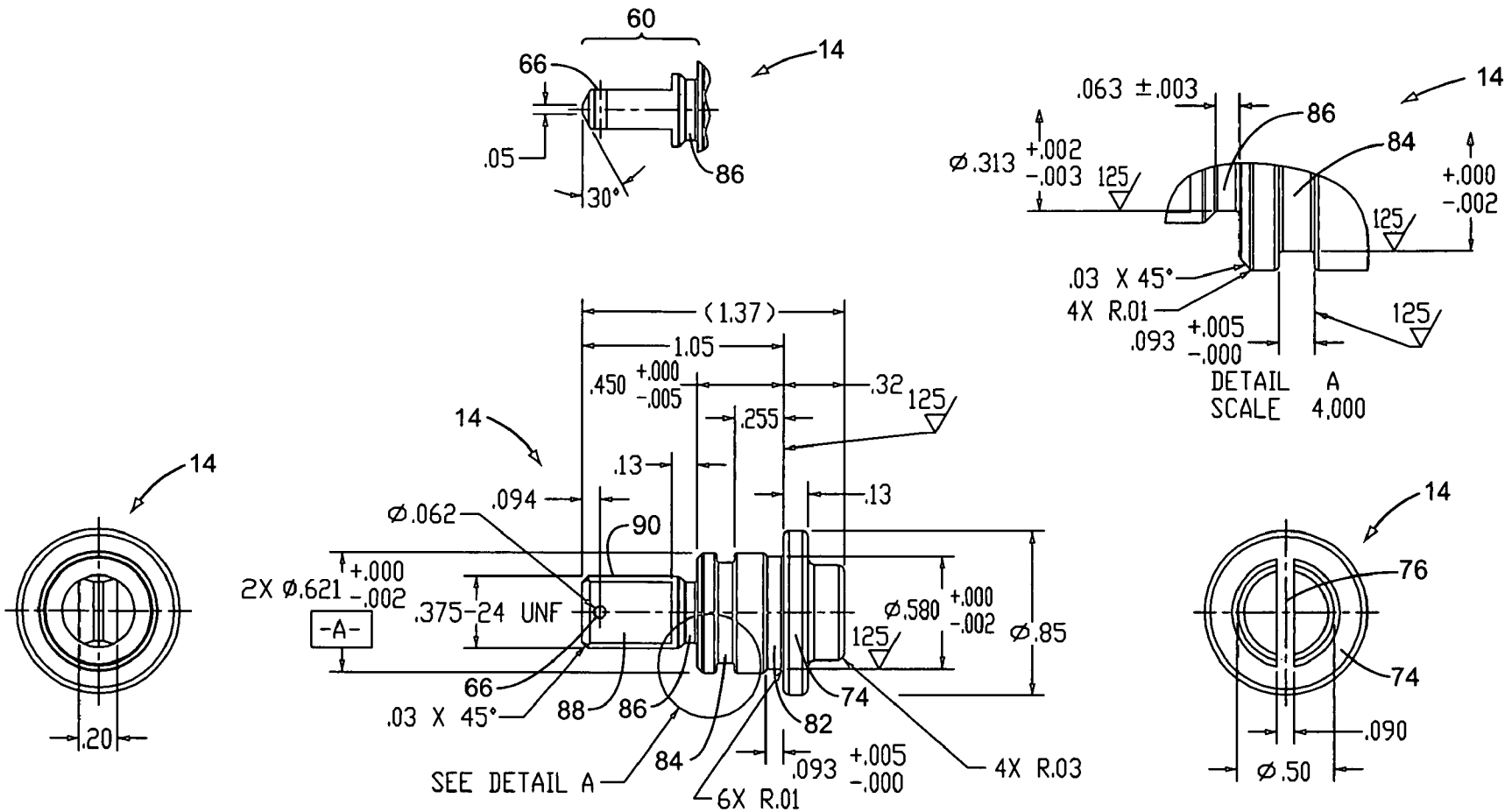
FIG. 4B is a detailed schematic diagram showing the dimensions of one embodiment of the air bleed screw illustrated in FIG. 4A.

FIG. 4B is a detailed schematic of one embodiment of the air bleed screw 12 that includes the physical dimensions of the air bleed screw 12. FIG. 4B merely illustrates the physical dimensions of the air bleed screw 12 and will be fully understood by one of ordinary skill in the art.

Those skilled in the art will recognize improvements and modifications to the preferred embodiments of the present invention. All such improvements and modifications are considered within the scope of the concepts disclosed herein and the claims that follow.

The invention claimed is:

1. A manifold for a submersible turbine pump that pumps fuel from an underground storage tank to a fuel dispenser, said manifold coupled to said underground storage tank by a riser pipe comprising a fuel supply path and an air return conduit separate from said fuel supply path, comprising:

a fuel discharge chamber that receives fuel from the underground storage tank via said fuel supply path and delivers the fuel to the fuel dispenser;

an air return path comprising said air return conduit coupled to the underground storage tank;

a bypass tube coupled to said air return path; and an air bleed mechanism coupled to said fuel discharge chamber;

said fuel discharge chamber is fluidly coupled to said bypass tube to return air from said fuel discharge chamber to the underground storage tank via said air return path when said air bleed mechanism is activated.

2. The manifold of claim 1 wherein said air bleed mechanism comprises:

a threaded orifice through an exterior wall of said manifold that couples said fuel discharge chamber to said bypass tube; and an air bleed screw inserted into said threaded orifice wherein said fuel discharge chamber is fluidly coupled to said bypass tube via said orifice when said air bleed screw is activated and said fuel discharge chamber is fluidly decoupled from said bypass tube when said air bleed screw is deactivated.

3. The manifold of claim 2 wherein said air bleed screw is activated by loosening said air bleed screw.

4. The manifold of claim 2 wherein said air bleed screw is deactivated by tightening said air bleed screw.

5. The manifold of claim 2 wherein said air bleed screw comprises:

a shaft, comprising:

a threaded portion having at least one flat, vertical side; and a sealing portion adapted to seal said fuel discharge chamber and said bypass tube from the environment.

6. The manifold of claim 5 wherein said at least one flat, vertical side of said threaded portion of said air bleed screw forms an air passage between said air bleed screw and said threaded orifice that fluidly couples said fuel discharge chamber to said bypass tube when said air bleed screw is loosened.

7. The manifold of claim 5 wherein said air bleed screw further comprises a head portion having a slot for receiving the head of a screwdriver.

8. The manifold of claim 5 wherein said shaft of said air bleed screw fuel comprises:

a bottom portion extending into said fuel discharge chamber;

an orifice through said bottom portion; and a pin passing through said orifice that limits upward movement of said air bleed screw to prevent removal of said air bleed screw from said threaded orifice in said manifold.

9. The manifold of claim 1 wherein said air return path comprises:

an air return chamber coupled to said bypass tube; and said air return conduit having a first end coupled to said air return chamber and a second end coupled to an ullage of the underground storage tank.

10. The manifold of claim 9 wherein said manifold further comprises a substantially cylindrical packer receiving orifice said air return chamber is formed by inserting a packer into the packer receiving orifice.

11. The manifold of claim 10 wherein said air return chamber comprises:

a substantially cylindrical chamber formed around the packer between an outer wall of the packer and said manifold; and a chamber within the packer that couples said substantially cylindrical chamber to said air return conduit.

12. The manifold of claim 1 wherein a pressure differential between said fuel discharge chamber and said air return path forces air within said fuel discharge chamber to flow through said bypass tube and into said air return path when said air bleed mechanism is activated.

13. A method of removing air from a fuel discharge chamber of a manifold of a submersible turbine pump that pumps fuel from an underground storage tank to a fuel dispenser through the fuel discharge chamber, said manifold coupled to said underground storage tank by a riser pipe comprising a fuel supply path and an air return conduit said method comprising:

manually activating an air bleed mechanism located in the manifold of the submersible turbine pump, thereby coupling the fuel discharge chamber to an air return path including said air return conduit via a bypass tube; and coupling said air return path to the underground storage tank such that air from the fuel discharge chamber is returned to the underground storage tank.

14. The method of claim 13 wherein said step of manually activating the air bleed mechanism comprises loosening an air bleed screw inserted into a threaded orifice in an exterior wall of the manifold that couples the fuel discharge chamber to the bypass tube such that the fuel discharge chamber is coupled to the bypass tube via the threaded orifice.

15. The method of claim 14 wherein the step of activating the air bleed mechanism further comprises inserting a head of a screwdriver into a slot in a head portion of the air bleed screw and rotating the air bleed screw counterclockwise, thereby loosening the air bleed screw such that the fuel discharge chamber is coupled to the bypass tube via the orifice.

16. The method of claim 14 further comprising manually deactivating the air bleed screw after the air is removed from the fuel discharge chamber.

17. The method of clam 14 wherein deactivating the air bleed screw comprises tightening said air bleed screw, thereby decoupling the fuel discharge chamber from the bypass tube and the air return path.

* * * * *